US008011870B2

(12) United States Patent
Venkatraman et al.

(10) Patent No.: US 8,011,870 B2
(45) Date of Patent: Sep. 6, 2011

(54) MULTI LEVEL AUTOMATED CAR PARKING SYSTEM

(76) Inventors: Subramanian Venkatraman, Tamilnadu (IN); Venkatraman Guruprasad, Tamilnadu (IN)

( * ) Notice: Subject to any disclaimer, the term of this patent is extended or adjusted under 35 U.S.C. 154(b) by 238 days.

(21) Appl. No.: 12/066,417

(22) PCT Filed: Sep. 11, 2006

(86) PCT No.: PCT/IN2006/000344

§ 371 (c)(1),
(2), (4) Date: Mar. 11, 2008

(87) PCT Pub. No.: WO2007/032024

PCT Pub. Date: Mar. 22, 2007

(65) Prior Publication Data

US 2009/0053025 A1 Feb. 26, 2009

(30) Foreign Application Priority Data

Sep. 13, 2005 (IN) ..... 1278/CHE/2005

(51) Int. Cl.
*E04H 6/12* (2006.01)

(52) U.S. Cl. ..... 414/234; 414/235; 414/239; 414/242; 414/262; 414/264

(58) Field of Classification Search ..... 414/234, 414/235, 239, 242, 244, 245, 262, 264
See application file for complete search history.

(56) References Cited

U.S. PATENT DOCUMENTS

| | | | | | |
|---|---|---|---|---|---|
| 1,609,315 | A | * | 12/1926 | Schraeder, Jr. et al. | 414/258 |
| 1,627,959 | A | * | 5/1927 | Disney | 414/262 |
| 2,308,656 | A | * | 1/1943 | Orr | 417/425 |
| 3,674,158 | A | * | 7/1972 | Owen | 414/234 |
| 5,024,571 | A | * | 6/1991 | Shahar et al. | 414/231 |
| 5,203,660 | A | * | 4/1993 | Takahiro | 414/257 |
| 5,470,185 | A | * | 11/1995 | Tsubota et al. | 414/264 |
| 5,678,972 | A | * | 10/1997 | Bockler et al. | 414/239 |
| 5,893,696 | A | * | 4/1999 | Belinsky | 414/255 |
| 6,851,921 | B2 | * | 2/2005 | Haag | 414/234 |

FOREIGN PATENT DOCUMENTS

| | | | |
|---|---|---|---|
| EP | 505808 | A2 * | 9/1992 |
| GB | 2180827 | A * | 4/1987 |
| WO | WO 93/08352 | A1 * | 4/1993 |

* cited by examiner

*Primary Examiner* — James Keenan
(74) *Attorney, Agent, or Firm* — Puget Patent; Michael Gibbons

(57) ABSTRACT

A structure having floors for receiving and delivery of cars, and parking floors. Receiving and delivery floors have slat conveyors with platform carriers placed in slots in the conveyor. Cars are parked by patrons on the platform carriers. After the patron exits the car the conveyor conveys the carrier on which the car is parked to the front of an elevator. A power arm in the elevator draws the carrier into the elevator, and the elevator rises to a parking floor. On the parking floor the elevator power arm pushes the platform carrier with the car on top onto a waiting transfer module, which moves laterally to the front of an allotted parking slot. A power arm on the transfer module pushes the platform carrier with the car on top into the parking slot. Upon the patron's return the car is retrieved as described above but in reverse order.

11 Claims, 10 Drawing Sheets

View AA

View BB

View CC

MULTI LEVEL AUTOMATED CAR PARKING SYSTEM

CROSS-REFERENCE TO RELATED APPLICATIONS

This application claims the benefit of PCT application PCT/IN06/000344 having a 371(c) filing date of Sep. 11, 2006.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION BY REFERENCE OF MATERIAL SUBMITTED ON A COMPACT DISC

Not applicable.

BACKGROUND OF THE INVENTION

Whereas multi level automatic car parking has become a basic infrastructure in the current economic development, besides the demand of fast and safe parking and retrieval, the over dimensional platform carriers, that too in large numbers, posed a challenge for handling and storage. There is a time gap between handling two successive cars. When a number of vehicles report simultaneously for parking as it happens during opening peak hours, the pressure on the system is so much as to cause a virtual breakdown. Cars reporting for parking have to wait in queue causing irritation to clients besides creating traffic congestion. Similarly, when the requests for retrievals pour in heavily at the closing hours, the system becomes unmanageable and goes haywire. So far no workable solution has emerged with the result that the growth of the multi level automatic parking units is hindered.

DESCRIPTION OF RELATED ART INCLUDING INFORMATION DISCLOSED UNDER 37 CFR 1.97 AND 1.98

U.S. Pat. No. 5,024,571, dated Jun. 18, 1991, stipulates one elevator for every entry and exit. The prior art thus deploys quite a good number of elevators to answer the simultaneous requests for parking and delivery. This has limitations and further adversely affects cost effectiveness and space saving. There are separate exit and entry points in the prior arts, and the transfer of platform carriers from exit to entry point is cumbersome. Some vague attempts have been tried by providing a multi-tier storage inside the elevator. Further, guide rails in each parking slot presents a challenge in alignment and maintenance. Solutions which include endless chain drives, or catching "dog drives", include a number of linkages that incorporate more potential points of failure, in addition to requiring substantial maintenance.

U.S. Pat. No. 3,984,012, dated Oct. 5, 1976, also deploys guiderails in each parking slot and suggests highly complicated technology to provide a sliding mechanism for bridging the gap between the guide ways on the parking slot and that on the transfer platform. Further, the pallets handling mechanism is cumbersome.

German Patent DE 93 05 367.3, dated Oct. 14, 1993, brings out the demands on the system, but fails to suggest suitable means to achieve the results, especially peak-hour traffic management. The suggestion of several units and the suggestion of pallets handling by slide wagons in the same shaft as vertical conveyor are not cost effective. Again, the stacking and reclaiming of pallets falls on the elevator, which is not desirable for fast operations.

U.K. Patent 2,180,827 A deploys a stacker crane and a cumbersome arrangement for the handling and transfer of pallets. The system cannot meet the requirements of a modern parking facility. A stacker crane is obsolete and is not acceptable from the present standpoint of safety.

European Patent 0.505,808 A2, dated Sep. 30, 1992, also suggests complicated two tier lifting arrangements, where the total number of tiers is determined by the hydraulic lift range. There is also a cumbersome transfer mechanism for handling pallets.

Korean Patent 93/08352, dated Apr. 29, 1992, mainly focuses on the pallet handling. The transfer is achieved by a sliding mechanism, which has its own limitations.

In fact none of the prior art patents offer a system which has the characteristics of speed, fault tolerance and low energy consumption required for a modern practical system. In short, handling of over-dimensional platform carriers in large numbers and the peak-hour pressure on the system remain unaddressed. Additionally, redundancy and fault tolerance measures also remain unaddressed. The failings of the prior art are evidenced by the fact that none of the patented technologies have been commercialized, despite heavy demand for a workable solution.

BRIEF SUMMARY OF THE INVENTION

This invention, therefore, is to overcome the drawbacks and disadvantages of the prior art systems and to offer multi level, automated car parking system in which the cars are stored into and retrieved from addressed slots automatically in a simple, practical, safe, speedy, reliable, user-friendly and cost-effective manner, in which cars to be parked are simultaneously received, in which retrieved cars are placed for simultaneous delivery and in which the platform carriers are automatically put into use when required and stack piled when not in use.

The invention is a building structure with plurality of floors, including a plurality of car receiving and delivery floors at the bottom of the building structure and topped with a plurality of parking floors. A car receiving and delivery floor is meant for either receiving cars to be left by customers for parking, or for delivery of cars being retrieved by customers. A car receiving and delivery floor has more floor height than the other floors, and has a plurality of either entry or exit points for cars and for customers. A car receiving and delivery floor also has a storage area, for stacks of "platform carriers" (the platform carriers to be discussed below). A parking floor provides storage space for cars.

Each parking floor has a runway at its center with a fixed track running along the line of parking, and a number of identified and marked storage spaces (hereafter termed as addressed parking slots) on either side of the runway. Each parking tier has one or more transfer modules.

A transfer module is a trolley-like device, with a steel structure frame, wheels, and a separate motor and drive arrangement mounted on it to move it along the fixed track both in forward and reverse direction. The transfer module has two levels: the top level to carry a "platform carrier", where a platform carrier is pallet-like device for carrying a car, a platform carrier having a steel structure, the platform carrier being fitted with wheels underneath, and the platform carrier having sliding brackets on its edges; and a lower level to accommodate a transfer module power arm, which has a separate drive mechanism and runs in either direction along a fixed second track mounted on the lower level of the transfer module, the fixed second track running transversely to the line of motion of the transfer module. The transfer module power arm is capable, when raised to the height of the top level of the transfer module, of pushing a platform carrier on and off the transfer module.

The transfer module power arm has a transfer module power arm lift, an electrically/hydraulically/pneumatically/magnetically operated lifting arrangement such that the transfer module power arm can be extended to the height of the platform carrier at the upper level of the transfer module in order to push or pull the platform carrier, or retracted to sit at the lower level of the transfer module. With this design, the transfer module power arm can push or pull the platform carrier in either direction. The transfer module power arm is capable of pushing a platform carrier with a car on its top into a parking slot on either side of the transfer module. It is also capable of pulling a platform carrier with a car on its top from a parking slot on either side of the transfer module. When retracted, the transfer module power arm can slide completely underneath the platform carrier from one end of the platform carrier to the other. The transfer module power arm also has an electromagnet at both ends to make and/or break contact with the platform carrier in order to move the platform carrier.

The building structure has one or more elevators oriented along the line of parking. Each elevator is capable of carrying one platform carrier with a car. This elevator is designed to move at a designed speed with load, and move at an increased speed with no load for more time-efficient operation. Each elevator has a fixed third track along the length and has an elevator power arm. The elevator power arm is similar to the transfer module power arm, running along the track in the elevator in either direction, and having its own drive mechanism. The elevator power arm also has an electromagnet at the end facing the elevator "doorway" to make and/or break contact with a platform carrier in order to move the platform carrier in and out of the elevator. The elevator power arm also has tapered protrusions which are supported by mounting brackets of the elevator power arm. The tapered elevator arm protrusions engage with matching receptacles in the side of the platform carrier. The tapered protrusions enable the elevator power arm to still engage with the platform carrier despite minor misalignments between the elevator and the floors of the building structure. The elevator power arm pulls a waiting platform carrier with a car on its top into the elevator, and upon the elevator reaching the desired floor, the elevator power arm pushes the platform carrier with the car on its top out of the elevator. In this manner, a car on top of a platform carrier is moved from a receiving floor to a parking floor. Later, that car is moved in the elevator while on top of a platform carrier from the parking floor to a delivery floor. The elevator power arm facilitates moving a platform carrier with the car on its top in and out of the elevator at the various parking floors. The elevator power arm also facilitates the transfer of a platform carrier with a car on its top between the elevator and the slat conveyors on the car receiving and delivery floors. The elevator power arm pulls the platform carrier with the car on its top from the slat conveyor into the elevator following receiving of a car, and pushes the platform carrier with the car on its top from the elevator onto the slat conveyor during delivery of a car.

On the building's car receiving and delivery floors are "slat conveyors." A car receiving and delivery floor has a trough at its center running along the line of parking. In that trough is a slat conveyor. The slat conveyor is comprised of slats, which are made of steel plates hinged together to form an endless conveyor. Three slats form a receptacle for a platform carrier. Alternating with the slats on the conveyor are steel grating walkways for drivers to enter and/or exit their vehicles. The car receiving and delivery floor has multiple exit or entry points, each exit or entry point corresponding to a slot for a platform carrier on the slat conveyor. The slat conveyor is driven by drum pulleys on either end, mechanisms for which reside in the storage area in which platform carriers are stored. The slat conveyor is driven by a drive motor, which also resides in the storage area, and the drive motor is capable of driving the conveyor in either direction. A plurality of bearings and support rollers provide support when cars and drivers are on top of the conveyor. A driver drives a car through an entry point onto a waiting, empty platform carrier that is sitting in the slat conveyor. After exiting the vehicle, the driver walks along the adjacent walkway on the slat conveyor and exits the building. When the slat conveyor is filled to its capacity with cars on its carrying side, the slat conveyor moves such that the car is in front of the elevator, at which time the elevator power arm pulls the car to be parked into the elevator.

Further, mounted in the trough along which the slat conveyor runs is a guide rail on either side of the slat conveyor. The sliding brackets of the platform carriers on which the cars are parked engage with these guide rails. The combination of the sliding bracket of the platform carrier engaged with a guide rail provides additional support for the platform carrier with the car parked on top of it while the platform carrier is in a slot of the slat conveyor. The guide rails are not present (are vacated) in the trough in front of the elevator, and at the "transit point" where platform carriers are added and removed from the slot conveyor and moved to and from the storage areas of the car receiving and delivery floors.

The slat conveyor is capable of carrying a platform carrier underneath the slat conveyor. Rollers at either end of the slat conveyor and the sliding bracket/guide rail combination keep the platform carrier engaged with the slat conveyor as the conveyor rotates the slats and steel gratings of the conveyor about the pulley at the end of the slat conveyor.

As described above, a platform carrier is a structure of steel similar to a trolley with wheels designed to carry one car. In prior art, platform carriers are normally of single piece construction. In the present invention, platform carriers are formed by a plurality of plates with hinged construction to facilitate placing and moving along an endless conveyor for automation purposes. The platform carrier also has receptacles at each end to match the tapered protrusions of the elevator power arm to accommodate minor misalignment between the elevator and a floor of the building structure. A platform carrier has electromagnetic components on each end, for engaging the elevator and transfer module power arms so that the platform carrier can be towed or pushed.

As described above, storage areas are present on car receiving and delivery floors, the storage areas to be used for stacks of platform carriers that are not in use. A handling system assigned to each slat conveyor is used for the unused platform carriers, and is comprised of a mono rail, hoisting equipment, and a lifting tackle. The handling system for the platform carriers is used to place platform carriers in stacks in the storage area, or to retrieve a platform carrier from storage and place it on the slat conveyor.

A central system controller manages the automation of the Multi Level Automated Car Parking System. The function of the controller is to coordinate, command, supervise and monitor the operations of all the handling equipment, to display and guide the customers at the main driveway to the building as to which point they should choose for leaving and delivery of their cars, to avoid unproductive back and forth movement of cars and person and strain on the drivers; and to achieve the desired results safely and in time.

BRIEF DESCRIPTION OF THE SEVERAL VIEWS OF THE DRAWINGS

The accompanying drawings are intended to provide further understanding of the invention and are incorporated in and constitute a part of the invention. The drawings illustrate an embodiment of the invention and together with the description illustrate the principles of the invention. The drawings should not be taken as implying any necessary limitation or the essential scope of the invention. The drawings are given by way of non limitative example to explain the nature of the invention. For a more complete understanding of the instant invention reference is now made to the following description taken in conjunction with accompanying drawings.

Figure 1:
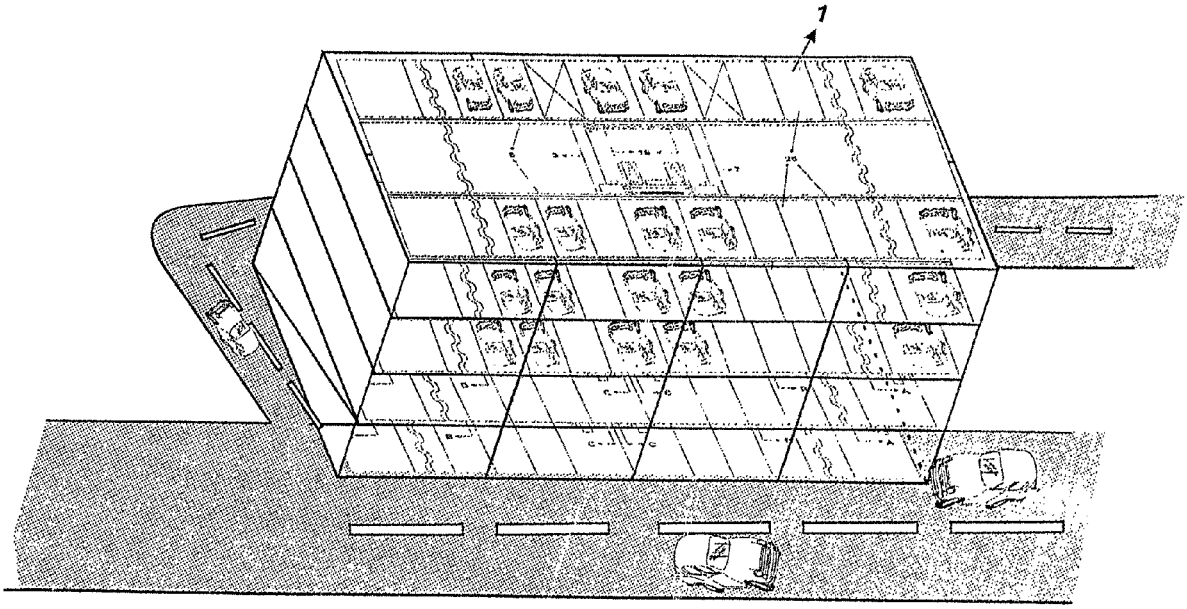
FIG. 1 is the general view of the parking system.

The following are the component identification that is used to refer to the embodiments of the system:

1. Multi level automatic car parking unit
2. Basement (delivery station)
3. Ground Floor (receiving station)
4. Parking floor
5. Entry points
6. Exit points
7. Parking slots
8. Transfer module track
9. Slat conveyor
10. Walkways
11. Space for platform carrier
12. Return drum/drive drum
13. Drive Motor
14. Bearings
15. Support rollers
16. Guide rails for platform carriers
17. Transfer module
18. Transfer module drive
19. Transfer module Power arm track
20. Transfer module Power arm
21. Transfer module Power arm drive
22. Transfer module Power arm magnetic coupler
23. Transfer module Power arm lift
24. Elevator
25. Elevator power arm track
26. Elevator power arm
27. Tapered elevator power arm protrusions
28. Elevator power arm mounting brackets
29. Elevator power arm magnetic coupler
30. Platform carrier
30*a*. Platform carrier wheels
31. Sliding brackets
32. Platform carrier power arm receptacles
33. Platform carrier magnetic engagement means
34. Platform carrier storage area
35. Mono rail
36. Hoisting equipment
37. Lifting tackle
38. System controller

DETAILED DESCRIPTION OF THE INVENTION

Figure 2:
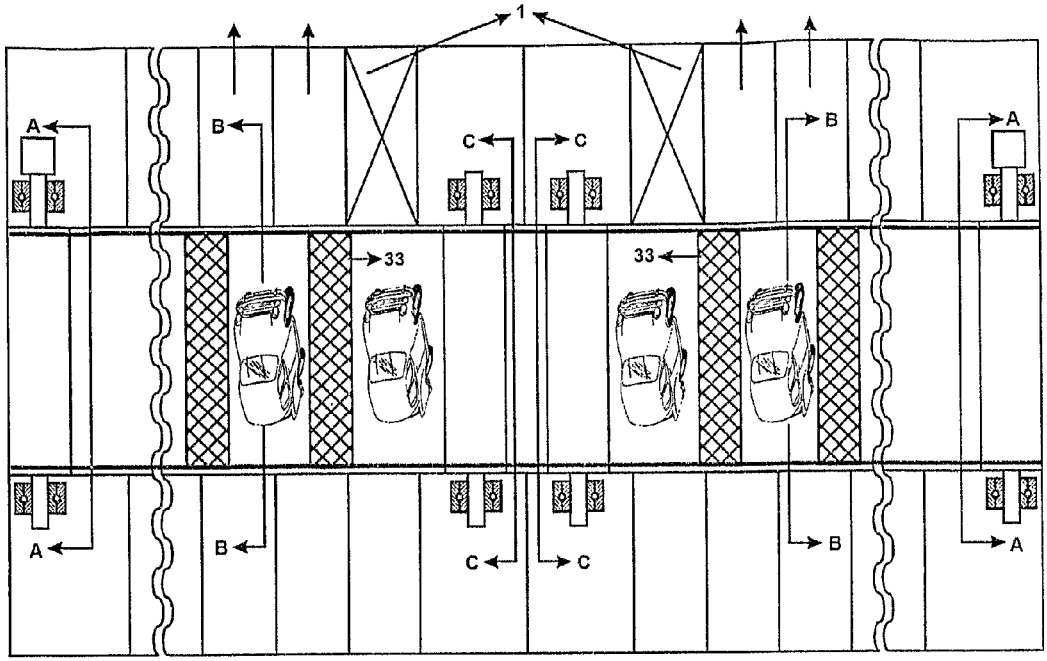
FIG. 2 is the plan view of the basement where retrieved cars are delivered.
Figure 3:
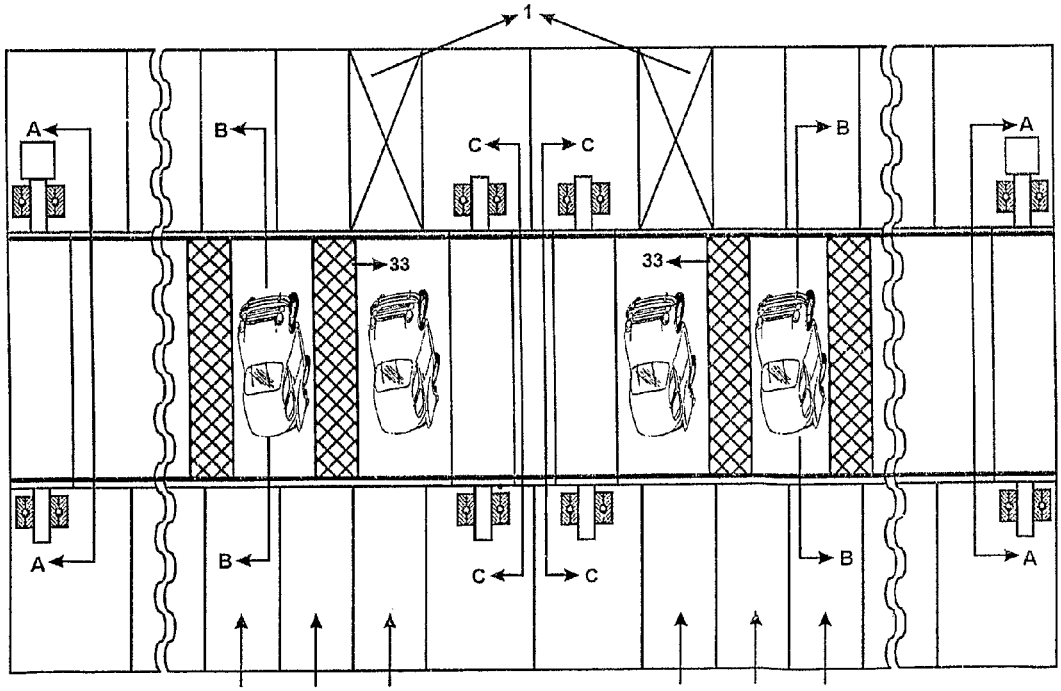
FIG. 3 is the plan view of the ground floor where cars are received for parking
Figure 4:
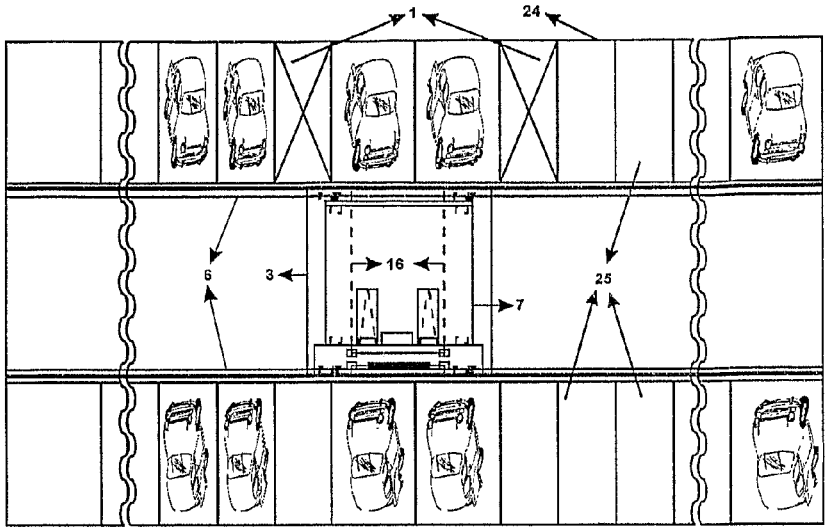
FIG. 4 is the plan view of a typical parking floor.
Figure 5:
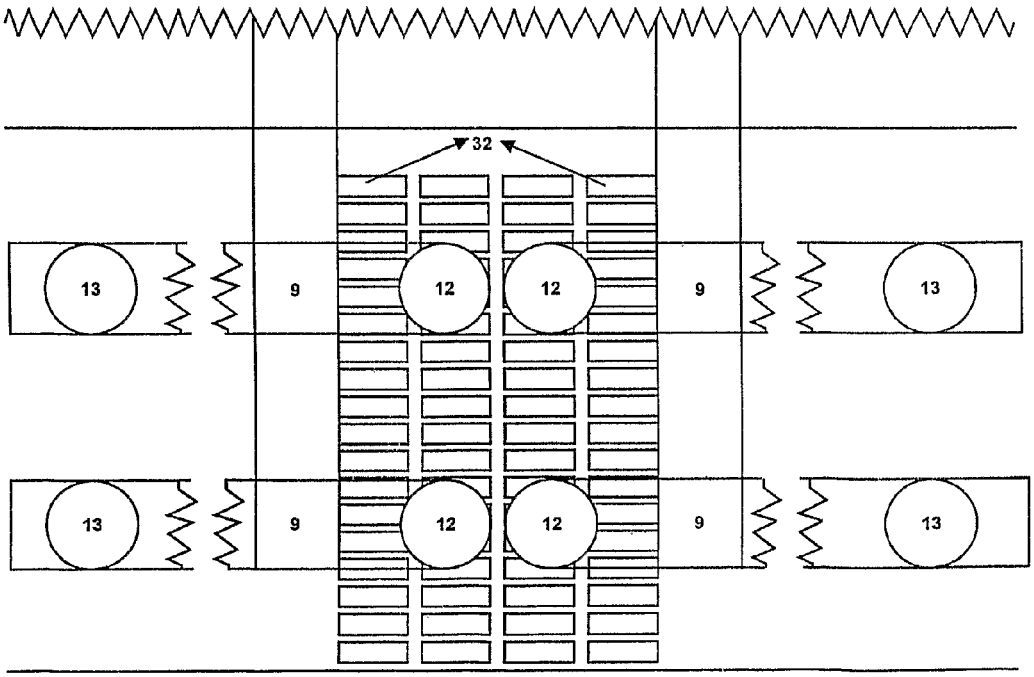
FIG. 5 is the schematic elevation of the facility with slat conveyors and stacked platform carriers in position.
Figure 8:
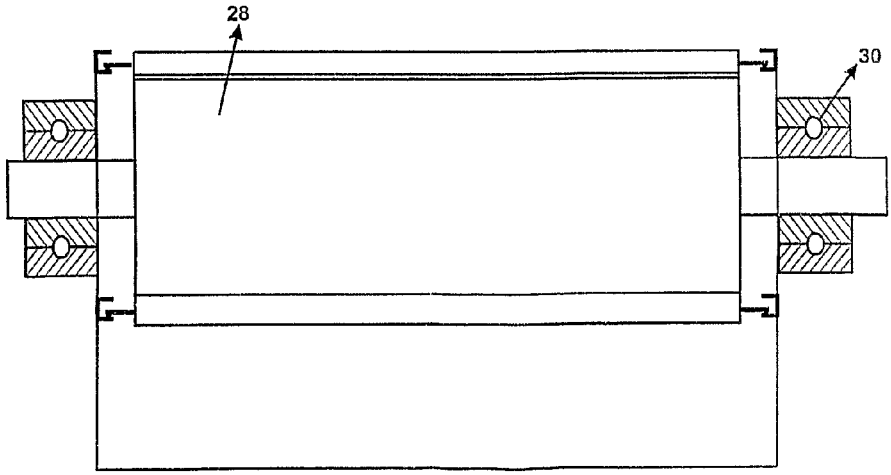
FIG. 8 is the view CC showing the non-drive end of the slat conveyor.
Figure 10A:
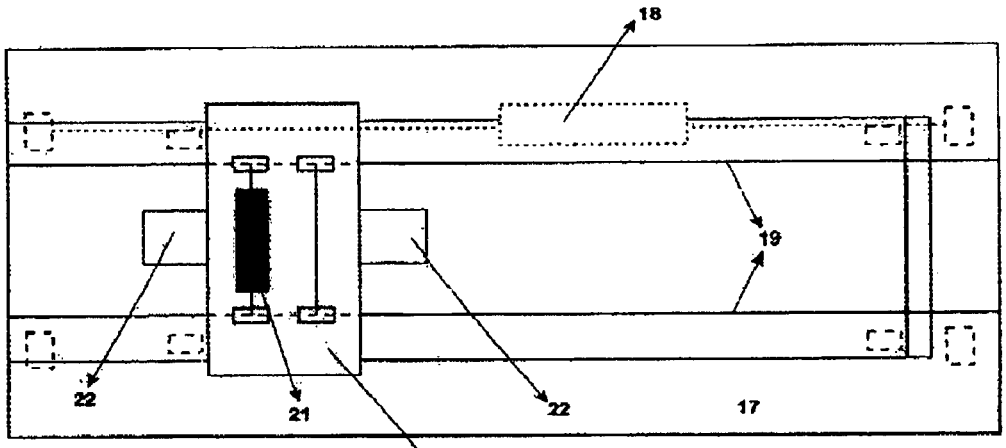
FIG. 10*a* is the schematic plan view of the transfer module and a transfer module power arm.
Figures 11A, 11B:
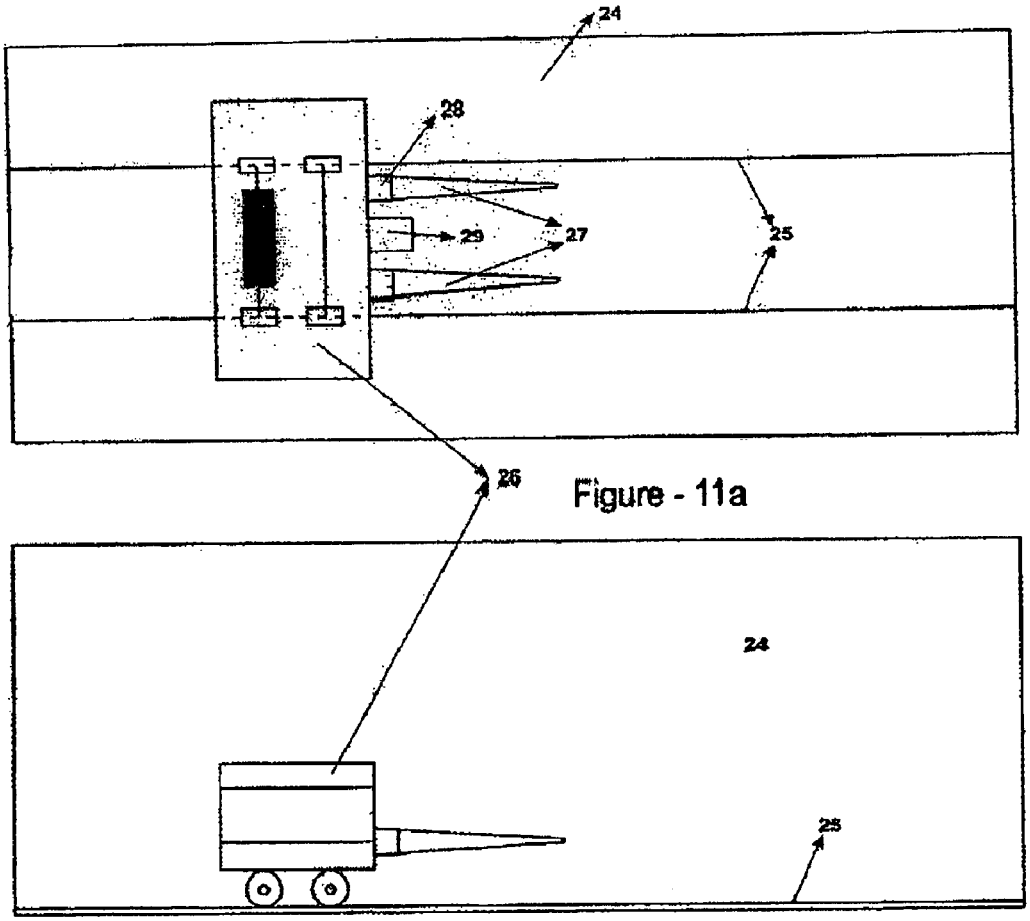
FIG. 11*a* is the schematic plan view of the elevator with an elevator power arm.
FIG. 11*b* is the schematic elevation of the elevator with an elevator power arm.

The system will now be described fully with the help of the figures accompanying the invention:

A general view of the parking facility (Part 1, FIG. 1) is shown. It is a typical one, but with one lower floor dedicated for delivery having two slat conveyors, a lower floor dedicated for receiving having two slat conveyors, upper floors for parking, and two elevators. The basement (Part 2, FIG. 2) of the parking facility is dedicated for delivery of the retrieved cars. Arrows in the basement at exit points (Part 6, FIG. 2) show the direction of the movement of retrieved cars. The ground floor (Part 3, FIG. 3) is similarly reserved for receiving cars reporting for parking. Arrows in the ground floor at entry points (Part 5, FIG. 3) show the direction of the movement of cars reporting for parking A typical parking floor (Part 4, FIG. 4) is shown with cars in the parking slots (Part 7, FIG. 4) and a transfer module (Part 17, FIGS. 4 & 10*a*) with a transfer module power arm (Part 20, FIGS. 4 & 10*a*&*b*) on the transfer module track (Part 8, FIG. 4). Two elevators (Part 24, FIG. 2, 3, 4, 5) are positioned with a gap to provide sufficient space to accommodate the return drums (Part 12, FIG. 8) of the two slat conveyors (Part 9, FIG. 2, 3, 5) in line and also provide storage space (Part 34, FIG. 5, 12) for the platform carriers (Part 30, FIG. 9, 4). Each elevator has an elevator power arm (Part 26, FIGS. 11*a*&*b*). This elevator power arm has its own drive mechanism and moves in both directions along a fixed track (Part 25, FIG. 11*a*) inside the elevator. The elevator power arm has two elevator power arm protrusions (Part 27, FIG. 11*b*) mounted on elevator power arm mounting brackets (Part 28, FIG. 11*b*) to accommodate minor mismatches in alignment between the elevator and the floors of the structure. The elevator power arm has an elevator power arm magnetic coupler (Part 29, FIG. 11*a*) to impart movement to a platform carrier.

Figure 10B:
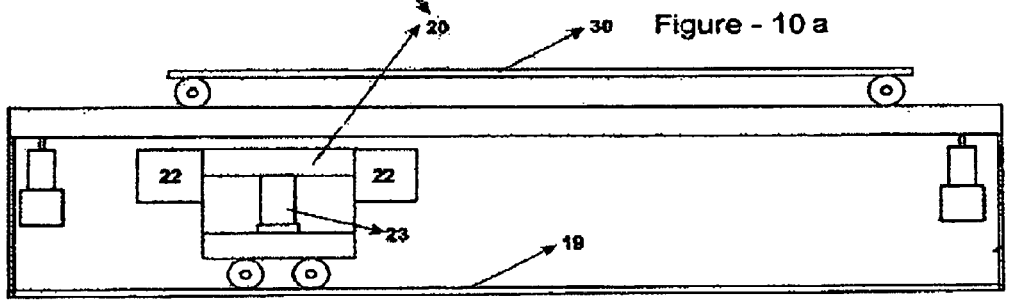
FIG. 10*b* is the schematic elevation of the transfer module and a transfer module power arm.

A transfer module (Part 17, FIGS. 4, 10*a*&*b*) is a structural assembly unit with its own independent transfer module drive (Part 18, FIG. 10*a*) designed to move the transfer module in either direction along the transfer module track. This transfer module runs along a transfer module track (Part 8, FIG. 4) parallel to the parking slots (Part 7, FIG. 4) in each parking floor (Part 4, FIG. 4). A transfer module power arm track (Part 19, FIG. 10*a*, 4) on the transfer module guides the movement of the transfer module power arm (Part 20, FIGS. 10*a*&*b*) transversely to the movement of the transfer module (Part 17, FIG. 4,10*a*). This transfer module power arm has its own transfer module power arm drive (Part 21, FIG. 10*a*) and moves in both directions along the power arm track fixedly mounted to the transfer module. This transfer module power arm also has a transfer module power arm lift to permit the movement of the transfer module power arm underneath the platform carrier and the car, if necessary, and to position the transfer module power arm magnetic coupler (Part 22, FIG. 10*b*) to push/tow the platform carrier in either direction.

Figure 6:
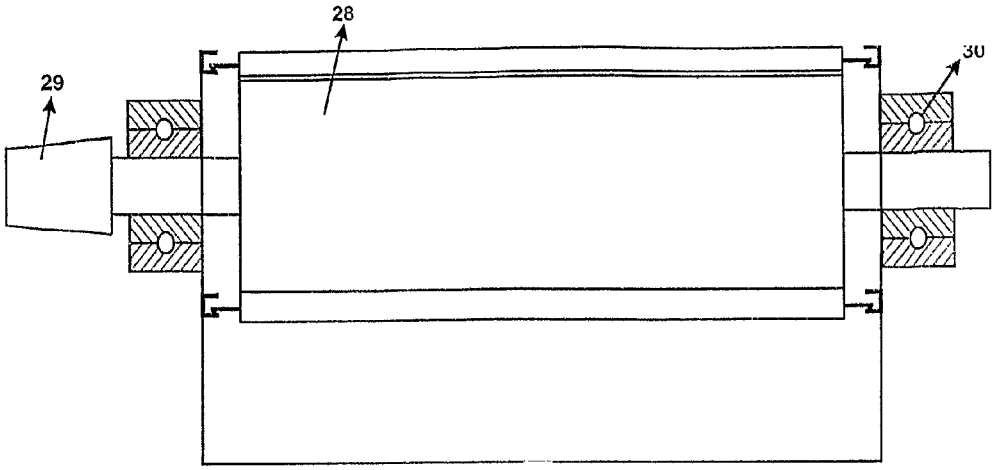
FIG. 6 is the view AA showing the drive end of the slat conveyor.
Figure 7:
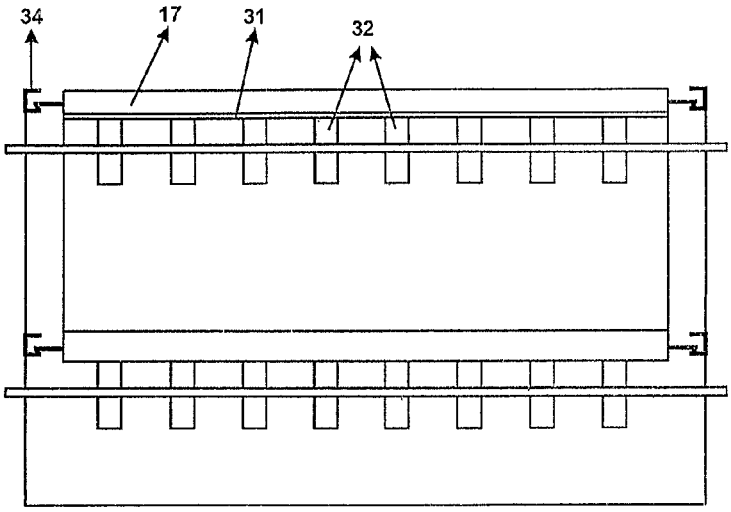
FIG. 7 is the view BB showing a portion of the slat conveyor.
Figures 9A, 9B:
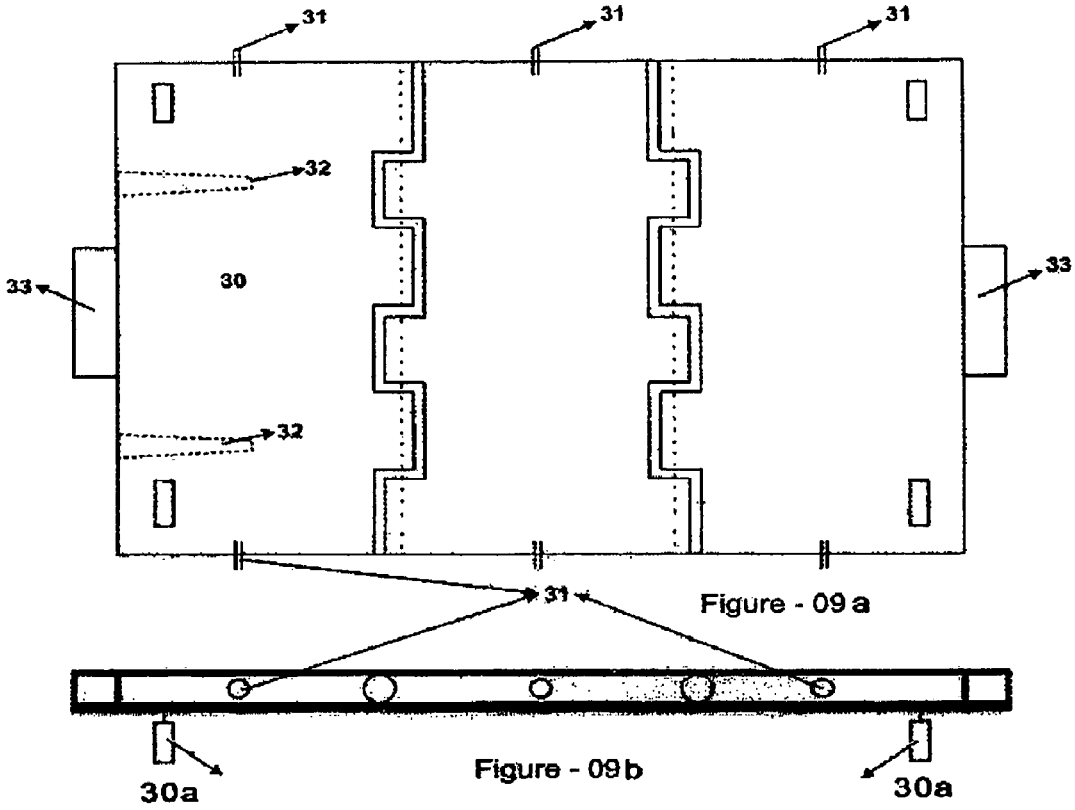
FIG. 9*a* is the plan view of a platform carrier.
FIG. 9*b* is the elevation of a platform carrier.

The slat conveyors (Part 9, FIG. 2,3) are driven by motors (Part 13, FIG. 6) and drive drum pulleys (Part 12, FIG. 6,8). The drive and return drums are supported by thrust bearings (Part 14, FIG. 6). Walkways (Part 10, FIG. 2,3) are permanently fixed on the top of the slat conveyors (Part 9, FIG. 2,3) with space (Part 11, FIG. 2,3) to accommodate platform carriers (Part 30, FIG. 9) between two adjacent walkways. Guide rails (Part 16, FIG. 7) run on the track along the slat conveyor to guide the movement of platform carriers (Part 30, FIG. 9). Construction of platform carriers is shown in FIG. 9. The platform carriers are comprised of plates which are joined by hinged joints. The platform carriers have sliding brackets on the exterior edges of the platform carriers (Part 31, FIGS. 9*a*&*b*), the sliding brackets designed to engage the guide rails along the slat conveyor. The platform carriers have tapered receptacles that engage with the tapered protrusions of the elevator arm (Part 32, FIG. 9*a*). The platform carriers have four wheels disposed on the surface opposite the surface on which the car rests (Part 30*a*, FIGS. 9*a*&*b*). The platform carriers have a platform carrier magnetic coupler on opposite ends of the platform carrier (Part 33, FIG. 9*a*), the magnetic couplers designed to engage with magnetic couplers on the elevator power arm (Part 29, FIG. 11*a*) and the transfer module power arm (Part 22, FIGS. 10*a*&*b*).

Support rollers (Part 15, FIG. 7) are provided to prevent sagging due to weight and due to hinged construction. Safety interlocks and guards ensure highest safety to clients and cars.

Figure 12:
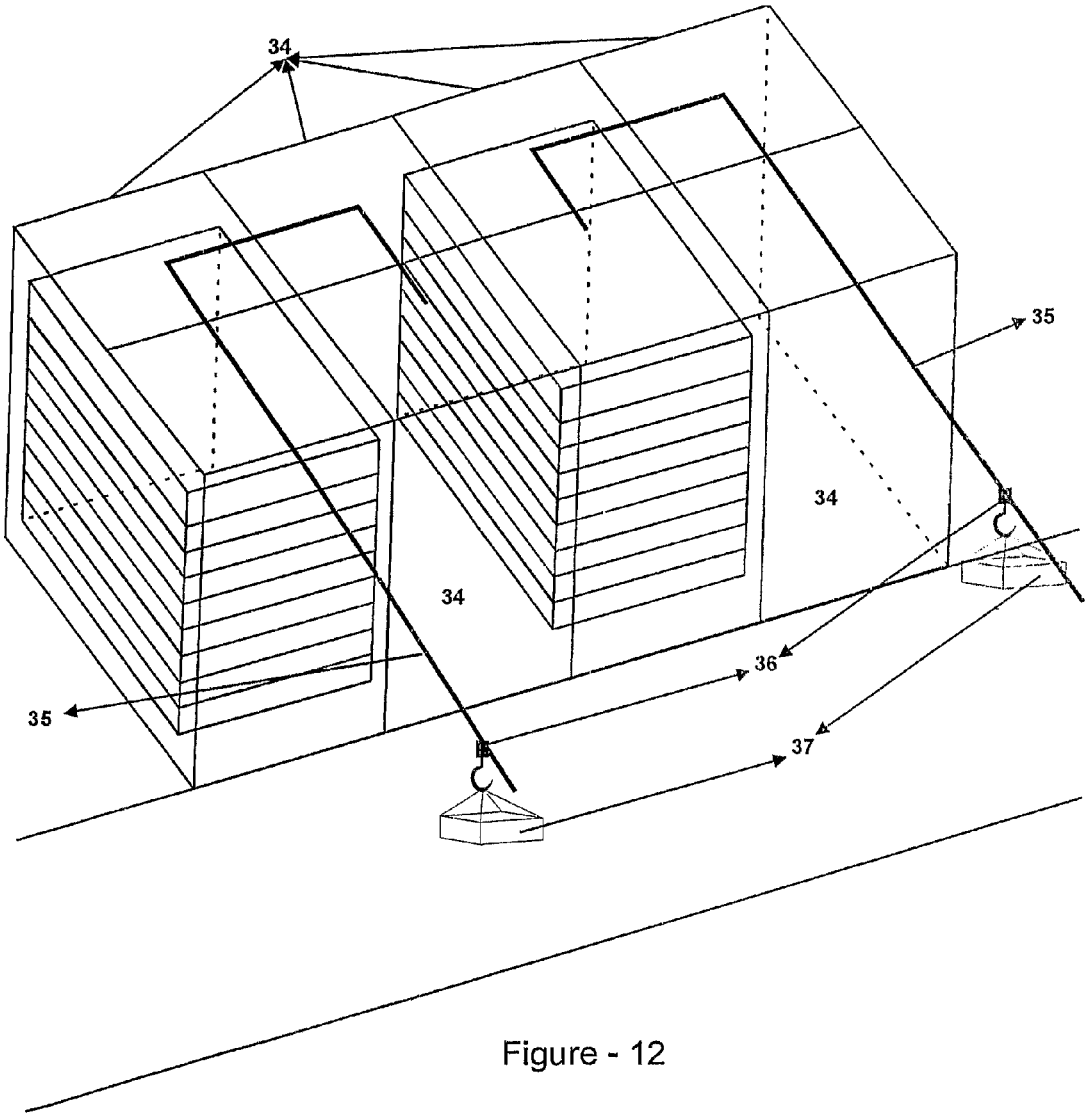
FIG. 12 is the isometric view of the handling system for platform carriers.

Four sets of handling systems comprising mono rail (Part 35, FIG. 12), hoisting equipments (Part 36, FIG. 12) and designed lifting tackles (Part 37, FIG. 12), two in basement and two at ground level, are provided.

Figure 13:
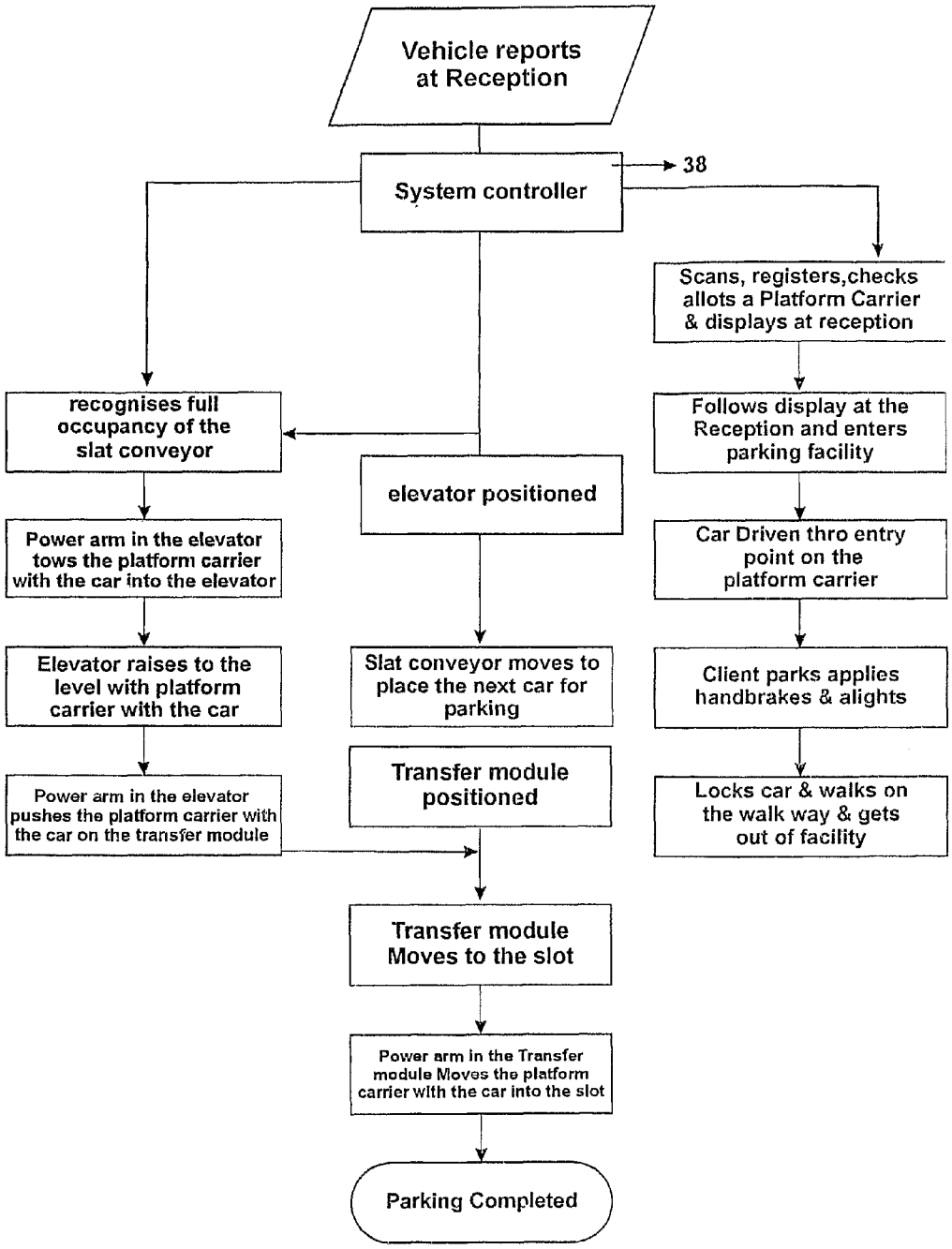
FIG. 13 is the flow chart for parking.

All these embodiments of the system, viz, elevators, power arms in the elevators, slat conveyors, transfer modules, transfer module power arms and the handling equipments, are programmed controlled and monitored to work in tandem with each other to ensure continuous parking and retrieval operations by the system controller (Part 38, FIG. 13,14).

The Operation of the System:

The uniqueness of this invention lies in its easy adaptability to meet changing patterns in parking/retrieval demands. The operations of the system, under normal and peak hour conditions, are described below:

Normal Conditions:

Parking: Normal conditions apply when cars reporting for parking more or less match the retrieval requests. As a car reports at the reception, the system controller acknowledges receipt of the car, checks availability and allots a platform carrier and displays and directs the client to the entry point at the ground level. The client following the instructions drives the car onto the allotted platform carrier, parks, applies hand brakes, alights, locks the car and walks away along the walkway. This is repeated until the slat conveyor is full. When one slat conveyor is full, the system controller recognizes and directs the further reporting car to the other vacant slat conveyor. Obeying command from the system controller, the elevator power arm, moving on the elevator power arm track, draws the platform carrier with the car immediately in front of it into the elevator. The elevator raises the car to a parking floor. On reaching the floor, the elevator power arm, similarly moving on the elevator power arm track, pushes the platform carrier with the car onto the waiting transfer module which was commanded to wait in place by the controller. The transfer module, moving on the transfer module track of the parking floor, carries the platform carrier with the car in front of the designated slot. On reaching the destination, the transfer module power arm positions itself to the right place. The transfer module power arm lift operates, and the magnetic coupling of the transfer module power arm engages with the magnetic coupling of the platform carrier. The transfer module power arm moves along the transfer module power arm track towards the allotted slot, pushing the platform carrier with the car into the allotted slot. The transfer module power arm after placing the car in the slot disengages the magnetic couplings and returns to its retracted position on the transfer module. The slat conveyor moves forward to place the next platform carrier with the car in front of the elevator to continue the parking operations till all the remaining platform carriers with cars are cleared from the slat conveyor. Such receiving and parking operations are alternated between the two slat conveyors on the ground floor. The whole thing is represented by a Flow Sheet (FIG. 13) for clarity.

Figure 14:
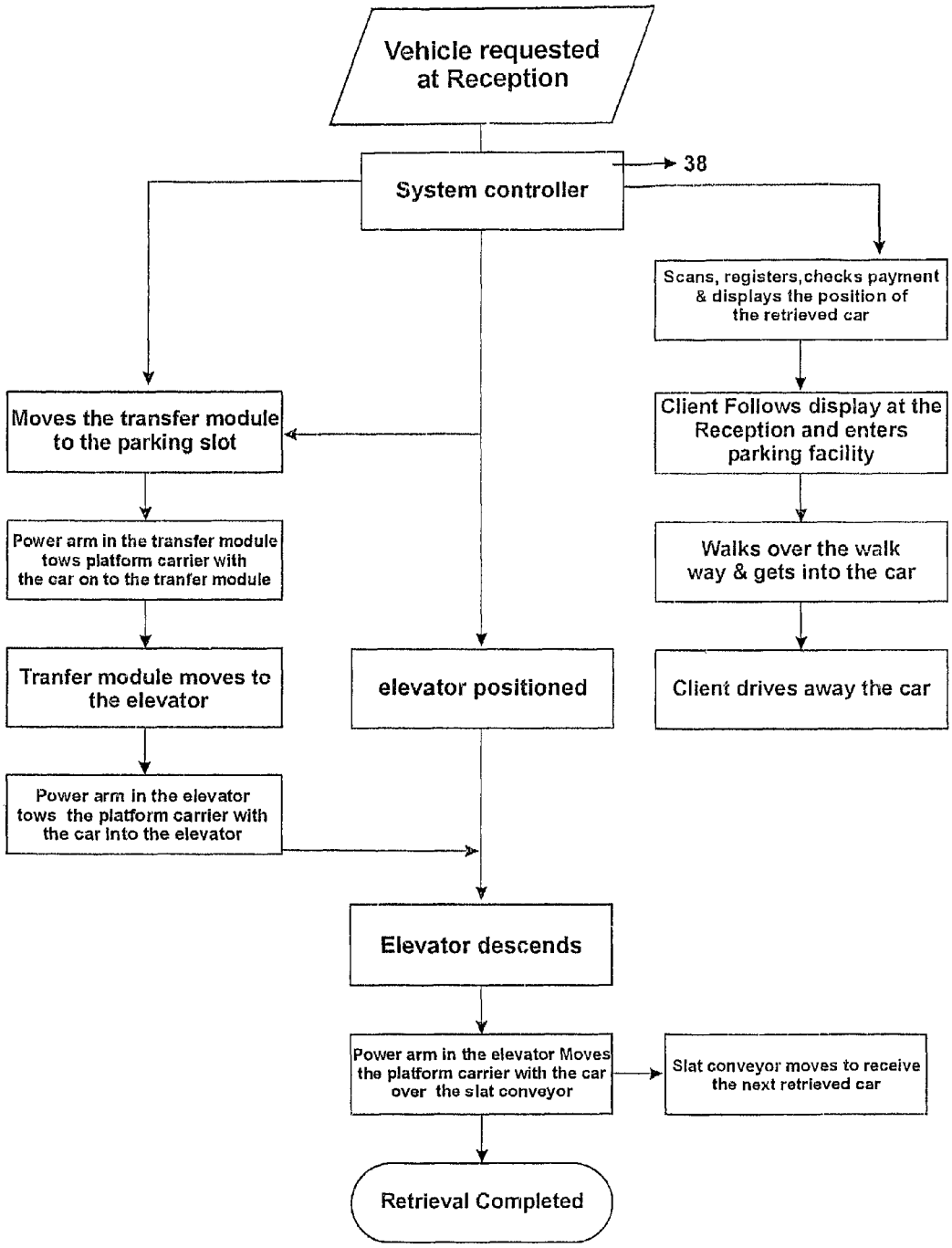
FIG. 14 is the flow chart for retrieval.

Retrieval: When a request for retrieval reaches the system controller, the system controller directs the transfer module in the specific parking floor to move along the transfer module track to reach the parking slot where the requested car is parked. On reaching, the transfer module power arm positions itself to the right place, operates the transfer module power arm lift, engages the transfer module power arm magnetic coupler with the platform carrier magnetic coupler, and moves along the transfer module power arm track in the transfer module towing the platform carrier with the particular car onto the transfer module. The transfer module, moving on the transfer module track, carries the platform carrier with the car to the waiting elevator and disengages the magnetic couplings. The elevator power arm, moving on the elevator power arm track, engages its magnetic coupling to the magnetic coupling of the platform carrier and draws the platform carrier with the car into the elevator and the elevator descends to the delivery floor. On reaching the delivery floor, the elevator power arm pushes the platform carrier with the car onto the vacant space in the slat conveyor immediately in front of the elevator and disengages the magnetic couplings. The slat conveyor moves forward to place the retrieved car to the delivery point and to simultaneously position the next vacant space in the slat conveyor to continue the retrieval operations till retrieved cars occupy all the vacant spaces in the slat conveyor. The client, informed by a main system display of the location of the client's car, walks up to his car and drives away. Such delivery and retrieval operations are alternated between the two slat conveyors in the basement. The whole thing is represented by a Flow Sheet (FIG. 14) for clarity.

Peak Hour Conditions:

Parking: At the start of the day, the demand for parking is at its peak. To cope with the situation, the system controller presses one or both of the slat conveyors in the delivery section into parking operations till the situation normalizes. The system controller takes additional care to coordinate among the slat conveyors for proper execution. By this arrangement, the capacity to handle parking requests is doubled.

Retrieval: Likewise, at the close of the day, the demand for retrieval is at its peak. To cope with the situation, the system controller presses one or both of the slat conveyors in the receiving section into retrieval operations till the situation normalizes. The system controller takes additional care to coordinate among the slat conveyors for proper execution. By this arrangement, the capacity to handle retrieval requests is doubled.

Handling (storage): Once the system controller recognizes full occupancy of the spaces by empty platform carriers in the delivery section of any slat conveyor, the system controller commands the handling system to come into operation. The handling arrangement picks up the platform carrier immediately below its loading point, carries along the mono rail and stacks alternately in two rows. The slat conveyor moves forward to bring the next platform carrier to be stored into the loading point. This operation continues till all the platform carriers in the slat conveyors are stacked.

Handling (Loading): Once the system controller recognizes full vacancy of the space in the receiving section of any slat conveyor, the system controller commands the handling system to come into operation. The handling arrangement picks up the platform carrier alternately from two storage rows, carries along the monorail and places on the slat conveyor in the vacant space immediately below the loading point. After receiving the platform carrier, the slat conveyor moves forward to bring the next vacant space into loading point for receiving next platform carrier. This operation continues till all the vacant spaces in the slat conveyor are loaded with platform carriers.

We claim:

1. A multi-level automated car parking unit, comprising:

a plurality of floors, the floors further comprising:

a plurality of car receiving and delivery floors, each car receiving and delivery floor further comprising:

a plurality of addressed parking slots of the car receiving and delivery floors;

a plurality of slat conveyors, the slat conveyors oriented parallel to a line of addressed parking slots of the car receiving and delivery floors, the slat conveyors disposed within a trough in the car receiving and delivery floor, wherein the direction of the slat conveyors is reversible;

a first and a second guide rail, the first and second guide rails being mounted along the trough in which the slat conveyor is disposed, the first and second guide rails being mounted on opposite sides of one another along the trough in which the slat conveyor is disposed, the first and second guide rails being vacated in front of a plurality of elevators, the first and second guide rails being vacated in front of a loading and unloading point of the slat conveyors; and a plurality of storage areas; and a plurality of parking floors, each parking floor further comprising:

a plurality of addressed parking slots of the parking floors, oriented in a line disposed along opposite walls of the parking floor;

a plurality of transfer modules; and a transfer module track having a first rail and a second rail, where the transfer module track is oriented parallel to the addressed parking slots of the parking floors;

a plurality of platform carriers, the platform carriers further comprising:

a plurality of plates, wherein the plates are joined by a plurality of hinged joints, where the plates form a surface having a top side on which a car can be parked and carried and a bottom side disposed opposite the top side;

a plurality of sliding brackets, the sliding brackets which when the platform carrier is inserted into the slat conveyor interlock with the guide rails mounted within the trough in which the slat conveyor is disposed;

a plurality of power arm receptacles, the power arm receptacles being disposed on an edge of the platform carrier facing an elevator when the platform carrier is in use;

a plurality of magnetic couplers, the magnetic couplers being disposed on opposite edges of the platform carrier; and a plurality of wheels fixedly attached to the bottom side;

a plurality of elevators, the elevators having a shaft that is disposed through the plurality of floors, the elevators being vertically movable among the plurality of floors; and a system controller.

2. The multi-level automated car parking unit of claim 1, wherein the slat conveyors further comprise:

a drum pulley;

a drive motor;

a plurality of bearings;

a plurality of support rollers; and a conveyor, the conveyor being disposed with a plurality of walkways alternated with a plurality of spaces, each of the plurality of spaces configured to receive a platform carrier of the plurality of platform carriers.

3. The multi-level automated car parking unit of claim 2, wherein the transfer modules rest upon the transfer module track, wherein the transfer modules further comprise:

a transfer module drive, the transfer module being driven by the transfer module drive in either direction along the transfer module track;

a power arm track fixedly mounted on the transfer module, the power arm track transversely disposed to the transfer module track, the power arm track having a first rail and a second rail; and a power arm of the transfer module, the power arm resting upon the power arm track, the power arm comprising:

a transfer module power arm drive, the transfer module power arm being driven by the transfer module power arm drive in either direction along the power arm track;

a first transfer module power arm magnetic coupling and a second transfer module power arm magnetic coupling, the transfer module power arm magnetic couplings being disposed on opposite sides of the transfer module power arm; and a transfer module power arm lift.

4. The multi-level automated car parking unit of claim 3, wherein the storage area further comprises:

a mono rail;

a hoisting apparatus; and a lifting tackle.

5. A method of using the multi-level automated car parking unit of claim 4, comprising the steps of:

providing the multi-level automated car parking unit of claim 4;

determining, using software encoded in a non-transitory computer readable media, that a platform carrier is needed at a slat conveyor;

transferring a platform carrier from a storage area of a car receiving and delivery floor to a slat conveyor, further comprising the steps of:

moving the hoisting apparatus over a stack of platform carriers in the storage area;

lowering the hoisting apparatus;

grasping a platform carrier with the hoisting apparatus;

raising the hoisting apparatus;

moving the hoisting apparatus over an empty position of a slat conveyor;

lowering the hoisting apparatus with the platform carrier onto the empty position of a slat conveyor;

releasing the platform carrier from the hoisting apparatus;

raising the hoisting apparatus;

operating the slat conveyor to move the platform carrier to engage the sliding brackets of the platform carrier with the guide rails along the trough in which the slat conveyor is disposed; and returning the hoisting apparatus to a position over a stack of platform carriers in the storage area.

6. A method of using the multi-level automated car parking unit of claim 4, comprising the steps of:

providing the multi-level automated car parking unit of claim 4;

determining, using software encoded in a non-transitory computer readable media, that a platform carrier at a slat conveyor is needed to be stored in a storage area;

transferring a platform carrier from a slat conveyor to a storage area of a car receiving and delivery floor, further comprising the steps of:

operating the slat conveyor to move the platform carrier to a transit point of the slat conveyor;

moving the hoisting apparatus over the transit point of the slat conveyor;

lowering the hoisting apparatus over the slat conveyor;

grasping a platform carrier with the hoisting apparatus;

raising the hoisting apparatus and the platform carrier;

moving the hoisting apparatus over a stack of platform carriers in the storage area;

lowering the platform carrier onto a stack of platform carriers in the storage area;

releasing the platform carrier from the hoisting apparatus; and raising the hoisting apparatus.

7. The multi-level automated car parking unit of claim 3, wherein the lowermost car receiving and delivery floor is a basement, the basement further comprising a location for a plurality of cars to be delivered, the basement having a plurality of exit points.

8. The multi-level automated car parking unit of claim 7, wherein the car receiving and delivery floor immediately above the basement is a ground floor, the ground floor further comprising a location for receiving a plurality of cars to be parked, the ground floor having a plurality of entry points.

9. The multi-level automated car parking unit of claim 8, wherein the elevator further comprises:

an elevator power arm track, the elevator power arm track having a first rail and a second rail, the elevator power arm track being fixedly mounted to a floor of the elevator, and the elevator power arm track transversely disposed to the transfer module track; and an elevator power arm, the elevator power arm further comprising:

an elevator power arm magnetic coupler, disposed on a side of the elevator power arm facing a transfer module;

an elevator power arm drive, the elevator power arm being driven by the elevator power arm drive in either direction along the elevator power arm track;

a plurality of elevator power arm mounting brackets, disposed on the same side of the elevator power arm as the elevator power arm magnetic coupler; and a plurality of tapered elevator power arm protrusions, the tapered elevator power arm protrusions disposed on top of and supported by the elevator power arm mounting brackets, the tapered elevator power arm protrusions engaging the power arm receptacles of a platform carrier.

10. A method of using the multi-level automated car parking unit of claim 9, comprising the steps of:

providing the multi-level automated car parking unit of claim 9;

receiving a car on top of a platform carrier on the slat conveyor;

determining, using software encoded in a non-transitory computer readable media, an empty addressed parking slot on a particular parking floor;

operating the slat conveyor to move the platform carrier and the car on top of the platform carrier in front of an elevator;

summoning the elevator;

waiting for the arrival of the elevator;

operating the elevator power arm drive to move the elevator power arm adjacent to the platform carrier such that the tapered elevator power arm protrusions engage the platform carrier at the power arm receptacles of the platform carrier;

engaging the elevator power arm magnetic coupler to magnetically couple the elevator power arm with the magnetic coupler of the platform carrier;

operating the elevator power arm drive to move the elevator power arm into the elevator, thereby pulling the platform carrier and the car on top of the platform carrier into the elevator;

operating the elevator to raise it to a parking floor;

summoning a transfer module of the parking floor;

waiting for the arrival of the transfer module of the parking floor;

operating the elevator power arm drive to move the elevator power arm towards a transfer module of the parking floor, thereby pushing the platform carrier and the car on top of the platform carrier onto the transfer module;

disengaging the elevator power arm magnetic coupler, thereby decoupling the elevator power arm from the magnetic coupler of the platform carrier;

operating the elevator power arm drive to move the elevator power arm into the elevator, thereby disengaging the tapered elevator power arm protrusions from the power arm receptacles of the platform carrier;

operating the transfer module drive to move the transfer module in front of the empty addressed parking slot of the parking floor;

operating the transfer module power arm drive to move the transfer module power arm below the platform carrier to a position opposite the empty addressed parking slot of the parking floor;

operating the transfer module power arm lift to raise the transfer module power arm;

engaging the transfer module power arm magnetic coupling to magnetically couple the transfer module power arm with the magnetic coupler of the platform carrier;

operating the transfer module power arm drive to move the transfer module power arm, thereby pushing the platform carrier and the car on top of the platform carrier into the empty addressed parking slot of the parking floor;

disengaging the transfer module power arm magnetic coupling, thereby decoupling the transfer module power arm from the magnetic coupler of the platform carrier;

operating the transfer module power arm drive to move the transfer module power arm away from the platform carrier; and operating the transfer module power arm lift to lower the transfer module power arm.

11. A method of using the multi-level automated car parking unit of claim 9, comprising the steps of:

providing the multi-level automated car parking unit of claim 9;

determining, using software encoded in a non-transitory computer readable media, an addressed parking slot on a particular parking floor from which a car is to be retrieved;

operating the transfer module drive of a transfer module of the particular parking floor from which the car is to be retrieved to move the transfer module in front of the addressed parking slot of the particular parking floor from which the car is to be retrieved;

operating the transfer module power arm lift to raise the transfer module power arm;

operating the transfer module power arm drive to move the transfer module power arm towards a platform carrier and a car on top of the platform carrier in the addressed parking slot;

engaging a transfer module power arm magnetic coupling to magnetically couple the transfer module power arm with a magnetic coupler of the platform carrier;

operating the transfer module power arm drive to move the transfer module power arm, thereby pulling the platform carrier and the car on top of the platform carrier onto the transfer module;

disengaging the transfer module power arm magnetic coupling, thereby decoupling the transfer module power arm from the magnetic coupler of the platform carrier;

operating the transfer module power arm lift to lower the transfer module power arm;

operating the transfer module drive to move the transfer module in front of the elevator;

summoning the elevator;

waiting for the arrival of the elevator;

operating the elevator power arm drive to move the elevator power arm towards the transfer module such that the tapered elevator power arm protrusions engage the platform carrier at the power arm receptacles of the platform carrier;

engaging the elevator power arm magnetic coupler to magnetically couple the elevator power arm with the magnetic coupler of the platform carrier;

operating the elevator power arm drive to move the elevator power arm into the elevator, thereby pulling the platform carrier and the car on top of the platform carrier into the elevator;

operating the elevator to lower it to the basement;

operating a slat conveyor of the basement to place an empty space for a platform carrier of the slat conveyor in front of the elevator;

operating the elevator power arm drive to move the elevator power arm towards the slat conveyor of the basement, thereby pushing the platform carrier and the car on top of the platform carrier into the empty slot of the slat conveyor;

disengaging the elevator power arm magnetic coupler, thereby decoupling the elevator power arm from the magnetic coupler of the platform carrier;

operating the elevator power arm drive to move the elevator power arm into the elevator, thereby disengaging the tapered elevator power arm protrusions from the power arm receptacles of platform carrier;

operating the slat conveyor to move the platform carrier in front of an exit point; and signaling that the car on top of the platform carrier is ready for retrieval by a driver.

* * * * *